US010665062B1

(12) United States Patent
Lubin et al.

(10) Patent No.: US 10,665,062 B1
(45) Date of Patent: May 26, 2020

(54) MODIFIED PAI GOW METHOD WITH BACCARAT RULES

(71) Applicants: SG Gaming, Inc., Las Vegas, NV (US); Prapaisri Lubin, Las Vegas, NV (US)

(72) Inventors: Daniel Lubin, Las Vegas, NV (US); Michael Shackleford, Las Vegas, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/486,270

(22) Filed: Apr. 12, 2017

Related U.S. Application Data

(60) Provisional application No. 62/321,673, filed on Apr. 12, 2016.

(51) Int. Cl.
*A63F 9/24* (2006.01)
*G07F 17/32* (2006.01)

(52) U.S. Cl.
CPC ..... *G07F 17/3293* (2013.01); *G07F 17/3272* (2013.01)

(58) Field of Classification Search
CPC ..... A63F 13/42; A63F 3/00157; A63F 1/00; A63F 1/12; G07F 17/3293
See application file for complete search history.

(56) References Cited

U.S. PATENT DOCUMENTS 7,434,807 B2 * 10/2008 Wong ..... A63F 1/00 273/274
2007/0018405 A1 * 1/2007 Au-Yeung ..... A63F 1/00 273/292
2010/0276886 A1 * 11/2010 Smith ..... A63F 3/00157 273/292

(Continued)

OTHER PUBLICATIONS

Washington State Gambling Commission Approval Letter and Submission Materials for Supreme-99 Card Game (Nov. 24, 2014) 6 pages.

(Continued)

*Primary Examiner* — Steve Rowland
(74) *Attorney, Agent, or Firm* — TraskBritt

(57) ABSTRACT

Systems and methods of conducting wagering games involving, among other things, distributing groups of cards to form a player hand and a dealer hand; responsive to the group of cards being divided into a high hand and low hand by each of the players and the dealer, determining the game outcome wherein the high hand has a score that is equal to or higher than the low hand based on conventional Baccarat scoring rules, the game outcome being (i) a player win responsive to either of the player high or low hands outscoring the corresponding dealer high or low hands and the other player high or low hand score being at least equal to or greater than the other dealer high or low hand score; (ii) a loss responsive to the dealer high or low hands outscoring the corresponding player high or low hands and the other dealer high or low hand score being at least equal to or greater than the other player high or low hand score; (iii) a push under any other circumstance; and settling the wager received by either collecting the wager or awarding a payout based on the game outcome determined.

20 Claims, 9 Drawing Sheets

(56) References Cited

U.S. PATENT DOCUMENTS

| | | | | |
|---|---|---|---|---|
| 2014/0155131 | A1* | 6/2014 | Katz | G07F 17/326 463/12 |
| 2015/0065217 | A1* | 3/2015 | Au-Yeung | G07F 17/3267 463/12 |
| 2016/0019753 | A1* | 1/2016 | Snow | A63F 1/00 463/11 |
| 2016/0019760 | A1* | 1/2016 | Tarantino | G07F 17/3293 463/11 |
| 2016/0260294 | A1* | 9/2016 | Beltram | G07F 17/3293 |

OTHER PUBLICATIONS

Supreme 99 Brochure, SHFL entertainment, Inc. (Oct. 9, 2014) 1 page.

Global Gaming Expo 2014—Wizard of Odds, Web Article: https://wizardofodds.com/blog/global-gaming-expo-2014/, (Oct. 9, 2014) 13 pages.

* cited by examiner

MODIFIED PAI GOW METHOD WITH BACCARAT RULES

CROSS-REFERENCE TO RELATED APPLICATION(S)

This application claims the priority benefit of U.S. Provisional Patent Application No. 62/321,673 filed Apr. 12, 2016, the disclosure of which is incorporated herein by reference.

TECHNICAL FIELD

The present invention relates to the field of gaming, particularly to the field of wagering games involving real or virtual playing cards, and more particularly to modified wagering games.

BACKGROUND

Baccarat is a popular game that is played in most casino environments. It may take the form of a card table game, played with a shoe of cards that is typically an aggregation of several randomly-ordered standard decks of fifty-two physical playing cards, or it can be simulated as an electronic table game or an online game.

The object of the game of Baccarat is for the bettor to successfully wager on whether the Bank's hand or the Player's hand is going to win. The bettor receives even money for his wager if he selects the winning hand and loses his wager if he selects the losing hand. Because of the rules of play of Baccarat and more particularly the pre-established draw rules, the Bank's hand has a slightly higher chance of winning than does the Player's hand. The winning frequency for the Bank's hand has been determined to be 0.45859 (45.859%) whereas the winning frequency for the Player hand is 0.44624 (44.624%) with the remainder of the outcomes being ties. Therefore, if the bettor wagers on the Bank's hand and the Bank hand wins, the bettor must pay to the gaming establishment a commission (typically, 5%) of the amount the bettor wins. No commission is paid if the bettor successfully wagers on the Player's hand.

As used in this specification, the term "Conventional Manner of Play of Baccarat" is as follows:

A multiple number of decks of standard playing cards, 52 in number, are used; typically eight decks, or 416 playing cards, are shuffled together and placed in a shoe from which the cards are dealt during the play of the game.

Each bettor makes a wager on whether the Bank's hand or the Player's hand will win. After all wagers are made, two cards are dealt from the shoe to the Bank position and two cards are dealt from the shoe to the Player position on the table layout. The cards are turned face up and the value of the Bank hand the Player hand is determined, modulo ten.

Aces count one; Kings, Queens, Jacks and Tens count zero and the other cards count their respective face value. The suits (Spades, Hearts, Diamonds and Clubs) have no meaning in Baccarat.

The highest hand value in Baccarat is nine. All hand values range from a low of zero to a high of nine. If when the cards are added together, the total of the hand exceeds nine, then the hand value is determined modulo ten. For example, a seven and an eight total fifteen, but the hand value is five. An Ace and a nine total ten, but the hand value is zero.

A two card total of eight or nine is called a "natural"; a two card total of zero is called a "baccarat." As will be explained below, in certain situations in the play of the game, a third card will be dealt. The value of this third card is added to the total of the first two cards and a new hand value is established. Again, if the new hand total exceeds nine, the hand value is determined by subtracting ten from the total of the hand.

Prior to the deal, each better can make one of three wagers: 1) that the Bank hand will win; 2) that the Player hand will win; or 3) that the Bank hand and the Player hand will tie. Wagering locations are provided on the Baccarat table layout. Whichever of the Bank hand or the Player hand is closest to a total on nine is the winner.

All winning Bank hand wagers are paid off at odds of one-to-one and the house charges a five percent (5%) commission on the amount won by the bettor. For example, if a bettor wagers $100 on the Banker hand and the Banker hand wins, the bettor wins $100 and is charged a $5 commission on the amount that the bettor won.

All winning Player hand wagers are paid off at odds of one-to-one and the bettor is not charged any commission on the amount of his winnings or his wager because the house, by virtue of the third card draw rules, has a statistical advantage over the player of 45.859-44.624 or 1.235% which is the vigorish ("vig") of the house on player wagers. Winning wagers on the Tie hand bet are paid off at odds of nine-to-one or eight-to-one (depending on the gaming establishment) and the bettor is not charged any commission on the amount of his winnings or his wager since there is already a statistical advantage in favor of the house on tie wagers. If a Tie hand occurs, all wagers on the Bank hand and all wagers on the Player hand are "pushes" and the amount wagered is returned to the bettor.

Depending on the point total of the Player's hand and the Banker's hand, an additional card may be dealt to the Player's hand, the Banker's hand, or both. The rules for determining whether a third card is dealt are fixed rules, there is no discretion for either the Player's hand or the Banker's hand on whether a third card is dealt.

If either the Player hand or the Banker hand has a point total of eight or nine on the first two cards, no third card is dealt to either hand and the hand with the highest point total is the winner (or the hand is a Tie, as the case may be). If neither the Player hand nor the Banker hand has a point total of eight or nine, then there is a possibility of a third card draw.

The third card draw rules are as follows:

Rule #1: If the initial two card Player hand has a point total of 0, 1, 2, 3, 4 or 5, the Player hand draws a third card. If the initial two card Player hand has a point total of 6 or 7, the Player hand stands and does not receive a third card.

Rule #2: If the Player hand stands and does not draw a third card, then the Banker hand follows Rule #1. In other words, if the Player hand has a point total of 6 or 7, the Bank hand draws a third card on a point total of 0, 1, 2, 3, 4 or 5 and the Bank hand stands on a point total of 6 or 7.

Rule #3: If the Player hand draws a third card, the Bank hand must draw or stand as follows:

TABLE 1

| BACCARAT RULES |
|---|
| PLAYER |
| HAVING TWO CARD TOTAL OF |

TABLE 1-continued

| BACCARAT RULES | | |
|---|---|---|
| 1-2-3-4-5-10 | DRAWS A CARD | |
| 6-7 | STANDS | |
| 8-9 | TURNS CARDS OVER | |
| BANKER | | |
| HAVING TWO CARD TOTAL OF | DRAWS WHEN GIVING OR PLAYER'S THIRD CARD DRAW IS AN | DOES NOT DRAW WHEN GIVING OR PLAYER'S THIRD CARD DRAW IS AN |
| 0, 1, 2 | ALWAYS DRAWS | |
| 3 | 1-2-3-4-5-6-7-9-10 | 8 |
| 4 | 2-3-4-5-6-7 | 1-8-9-10 |
| 5 | 4-5-6-7 | 1-2-3-8-9-10 |
| 6 | 6-7 | 1-2-3-4-5-8-9-10 |
| 7 | STANDS | |
| 8-9 | TURNS CARDS OVER | |

At the end of each hand, winning wagers are paid and losing wagers are collected by the house. Any commission due to the house is marked in commission boxes in the center of the table. Gaming chips are used to represent the amount of money owed by each bettor to the house for the commissions. In order not to slow down the game, the commission is not actually collected from each bettor until the end of the round determined by all of the cards in the shoe being dealt down to the plastic cut card, usually approximately eighty hands.

The mathematical analysis of the game reveals that the 5% commission is what gives the house its advantage on wagers on the Banker hand and allows the gaming establishment to make a profit from providing the Baccarat game to the bettors. Because the rules for standing and drawing third cards are automatic, the mathematical analysis shows that the Bank hand will win 45.859% of the hands, the Player hand will win 44.624% of the hands and the Tie hand will occur 9.517% of the hands. If the Tie hands are disregarded because they do not affect any Player or Bank wagers, it is then determined that the Bank hand will win 50.7% of the time and the Player hand will win 49.3% of the time.

Because the Bank hand wins more than 50% of the hands (disregarding the Tie hands that do not affect any Player or Bank wagers), if a bettor always bet on the Bank hand, the bettor would have an advantage over the gaming establishment. By charging a 5% commission on all Bank hand wins, the gaming establishment compensates for the percentage of winning Bank hands being slightly over 50%.

After figuring in the 5% commission that must be paid by bettors on winning Bank hands, the gaming establishment has approximately a 1.23% advantage over the bettor when the bettor wagers on the Player hand and the gaming establishment has a 1.057% advantage over the bettor when the bettor wagers on the Bank hand. The Tie hand wager gives the gaming establishment a 4.88% advantage over the bettor when the payoff odds are nine-to-one and a 14.1% advantage over the bettor when the payoff odds are eight-to-one.

While baccarat is a very popular game, many new games which are quickly rising in popularity provide numerous wagering opportunities, thus increasing player participation and excitement. Consequently, further variations of existing wagering games are always of interest to players and casino operators, and therefore, there is a desire for systems and methods which would increase wagering in the game of baccarat.

BRIEF SUMMARY

Some embodiments of the invention are directed to a system for administering a wagering game responsive to detection of a wager being received, comprising: a card shuffling apparatus with a card recognition configured to: identify each playing card in at least two groups of randomized physical playing cards from one or more fifty two card standard decks of playing cards shuffled by the apparatus, wherein each group is further associated with at least one player hand and a dealer hand responsive to distribution of the groups from the apparatus; memory for storing executable code for determining the wagering game outcome based on the groups of cards distributed by the card shuffling apparatus, wherein the game outcome is determined by applying the following criteria: the group of cards being divided into a high hand and low hand by each of the players and the dealer, wherein the high hand has a score which is equal to or higher than the low hand based on conventional Baccarat scoring rules, the game outcome being (i) a player win responsive to either of the player high or low hands outscoring the corresponding dealer high or low hands and the other player high or low hand score being at least equal to or greater than the other dealer high or low hand score; (ii) a loss responsive to the dealer high or low hands outscoring the corresponding player high or low hands and the other dealer high or low hand score being at least equal to or greater than the other player high or low hand score; (iii) a push under any other circumstance; a processing device in communication with the card shuffling apparatus and memory for determining the game outcome based on configured to access game data stored in a memory and for distribution to form one or more player hands and a dealer hand; and settling the wager received by either collecting the wager or awarding a payout based on the game outcome determined by the processing device.

Some embodiments of the invention are directed to a method of administering a wagering game, comprising the steps of: receiving a wager; distributing groups of cards to form a player hand and a dealer hand; responsive to the group of cards being divided into a high hand and low hand by each of the players and the dealer, determining the game outcome wherein the high hand has a score which is equal to or higher than the low hand based on conventional Baccarat scoring rules, the game outcome being (i) a player win responsive to either of the player high or low hands outscoring the corresponding dealer high or low hands and the other player high or low hand score being at least equal to or greater than the other dealer high or low hand score; (ii) a loss responsive to the dealer high or low hands outscoring the corresponding player high or low hands and the other dealer high or low hand score being at least equal to or greater than the other player high or low hand score; (iii) a push under any other circumstance; and settling the wager received by either collecting the wager or awarding a payout based on the game outcome determined.

BRIEF DESCRIPTION OF THE DRAWINGS

While the disclosure concludes with claims particularly pointing out and distinctly claiming specific embodiments, various features and advantages of embodiments within the scope of this disclosure may be more readily ascertained from the following description when read in conjunction with the accompanying drawings, in which:

DETAILED DESCRIPTION

It should understood that the invention is generally directed to systems, methods and apparatus for providing, operating, hosting and conducting interactive wagering games generally involving sequences of controlled and concrete transformative events or steps, the generation of random results or data, and the use and application of the randomly generated results in a manner which provides for the resolution of both prior and/or subsequent events or steps.

In the exemplary embodiments disclosed herein, the invention includes various steps such as those involving the receiving of wagers, provision of randomly generated gaming implements, distribution of the gaming implements according to preset formations and procedures, comparison of one or more of such formations with preset criteria, determining the outcome of wagers received and then settling the wagers depending on the determined outcome by one of either the following actions: collecting the wagers; distributing an award payout; and returning the wager received.

It should be understood that the words "wager," "wagering," "betting" or "bet," or the like, refers to any type of points, money, credits, items of value, including physical or virtual representations thereof, which are placed at risk in that they may be forfeit depending on the occurrence and application of randomly generated data. Additionally, it should also be understood that gaming implements may include standard playing cards, and may be provided in a physical form, such as a randomly-ordered group of shuffled cards, or in a virtual form, such as a display device operatively associated with a processing device, memory and random number generator for randomly generating the depiction of a gaming implement on the display device.

Each of the methods and individual steps recited herein may be partially or wholly carried out in a variety of ways and/or systems, which may include, but are not limited to, a live dealer physically dealing gaming implements in a casino, an electronic gaming machine (EGM) or kiosk for one or more players in which a live dealer distributes randomly ordered gaming implements, gaming implements are used in combination with a mechanism such as a card shuffling apparatus with card reading features to create random results and determine game outcomes by processing the random results with a data processor, or gaming implements are provided through a program which may include a random number generator, standalone multiplayer platforms which may include a player interface such as a touchscreen display and a physical or virtual playing cards, through a home computer or portable computing device, such as a tablet computer or mobile phone capable of communicating with a network or over the Internet, global telecommunication network or world wide web.

Figure 1:
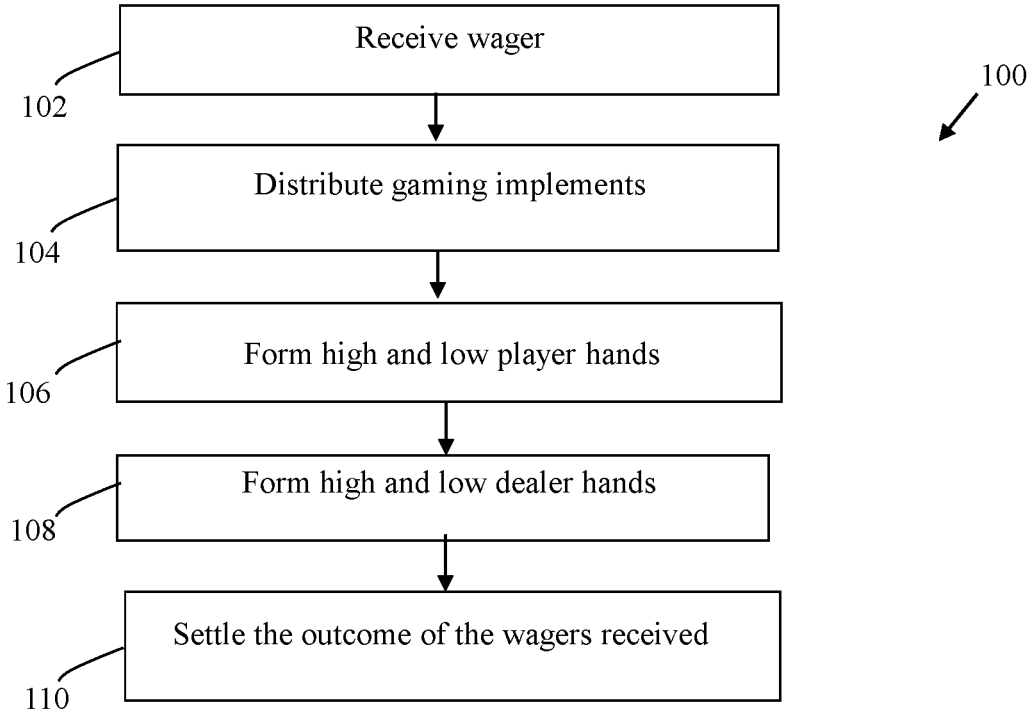
FIG. 1 is a process flow chart depicting an exemplary method for administering and conducting a wagering game configured and constructed according to some embodiments of the invention.

FIG. 1 provides an exemplary embodiment of the invention for providing a wagering game generally referred to by the reference numeral 100. In step 102, a main wager is received from one or more players. This step may involve receiving additional side wagers as discussed herein below in addition to the main wager. In step 104, gaming implements are distributed to each player and the dealer. In this embodiment, four cards are dealt to each player and the dealer to form two hands, with one of the two hands having an equal or higher baccarat score than the other according to conventional baccarat scoring rules, thus forming a high hand and a low hand.

It should be understood that receiving a wager, whether a wager on the outcome of the underlying game or side wager as described herein, generally involves positioning of the physical representations of monetary amounts (e.g., tokens or chips) into a designated area on the surface of a physical gaming table. The gaming table surface may include various areas designated thereon for placing wagers for receipt thereof, including an associated wager area for the side wager and an underlying game wager area, and designed areas for placing gaming implements, such as designated player positions for player wagers and gaming implements, and designated areas for the dealer and revealed gaming implements as discussed herein.

As shown by step 106, each player forms a high hand and a low hand of two cards each from the four cards dealt provided that the high hand has a baccarat score which is equal to or higher than the low hand. If physical card are used with a gaming table, then the high hand may be placed in a high hand area and the low hand may be placed in a low hand area of the gaming table.

As shown by step 108, the dealer high and low hands are formed by setting the high hand as high as possible from the four cards dealt, with the remaining two cards forming the low hand.

As shown by step 110, the outcome of the main and/or side wagers received in step 102 are settled by collecting the wagers or providing payouts based on the comparison each player high and low hand with the dealer high and low hand and any side wager criteria as discussed herein below.

In some embodiments, the dealer high and low hands must qualify or the main wager received in step 102 will push. In this embodiment, if the dealer high and low hand outscore the player high and low hand according to conventional Baccarat scoring rules, or if one of the dealer high or low hands copies the same high or low player hand and the other dealer hand outscores the other player hand, then the main wager received in step 102 is lost and collected. If the player's high and low hands outscore the dealer high and low hands, or one of the player's high or low hand copies the same high or low dealer hand and the other player's hand outscores the other dealer hand, then the main wager is won and a payout award is received which may be equal to the main wager. If one of the player's high or low hands outscores the high or low dealer hand, while the other dealer hand outscores the other high or low player's hand, or if both high and low dealer hands copy the player's high and low hands, then the main wager is a push.

In some embodiments, a player hand score of a high and low hand of 9 each will automatically win.

In some embodiments, a side wager may be received in step 102 which pays a multiple of the unit wager responsive to a player high and low hand having high hand/low hand scores of one or more of 9/9, 9/8, 8/8 or 9/7.

In some embodiments, a side wager may be received in step 102 which pays responsive to the total score of a player's high and low hand being equal to or less than a specific number such as six. In some embodiments, the payout on this side wager increases as the total score decreases, with a total score of zero receiving the highest payout award.

In some embodiments, a side wager may be received in step 102 which pays responsive to the difference between the scores of a player's high and low hand being equal to or less than a specific number such as six.

In some embodiments, a side wager may be received in step 102 which pays responsive to the player's high and low hand and/or dealer high and low hand scores being equal to one or more specific numbers, such as both being 9-9 and having certain cards or card characteristics, such as being suited or all one color.

In some embodiments, administering the wagering game of the invention involves the shuffling of the cards by an automated shuffling machine with card recognition software in communication with a processing device for determining the game outcome responsive to the final hand in the round being distributed. In some embodiments, the four card groups may be produced to an output tray by the shuffling machine for distribution to each player and the dealer position. Upon the last hand being distributed, which may be the dealer hand, the dealer may indicate such by action, such as pressing a button or by no action, such as by not distributing cards or a hand from the shuffler output tray, or upon the detection that the maximum amount of hands have been dealt.

In some embodiments, the shuffling machine is part of a table system including a physical gaming table, player monitors at each player position, a playing card reading and delivery system (e.g., commercially available shufflers and playing card delivery shoes with reading capability as sold under the Trade names of One2Six™ shuffler, Ace™ shuffler, I-DEAL™ shuffler, I-SHOE™ delivery shoe, etc.), a processor receiving information (numbers of cards, rank of cards, suits of cards, etc.) from the card reading and delivery systems, a communication connectivity (hardwired or wireless) between necessary combinations of the card reading/delivery systems and the processor, the processor and the individual player monitors, and/or the card reading/delivery systems and the video monitors, and software in the processor that defines predetermined advantage for distributions of playing cards into multiple hands, game rules, hand history, and the like, and determines the game outcome.

In some embodiments, the card handling device for administering the game as described herein is a hand-forming shuffler with integrated card recognition technology, from which playing cards are supplied, with a least a rank/count (and preferable also suit) of individual packs of cards are known before the cards are removed and delivered to player positions and/or the dealer position.

Figure 2:
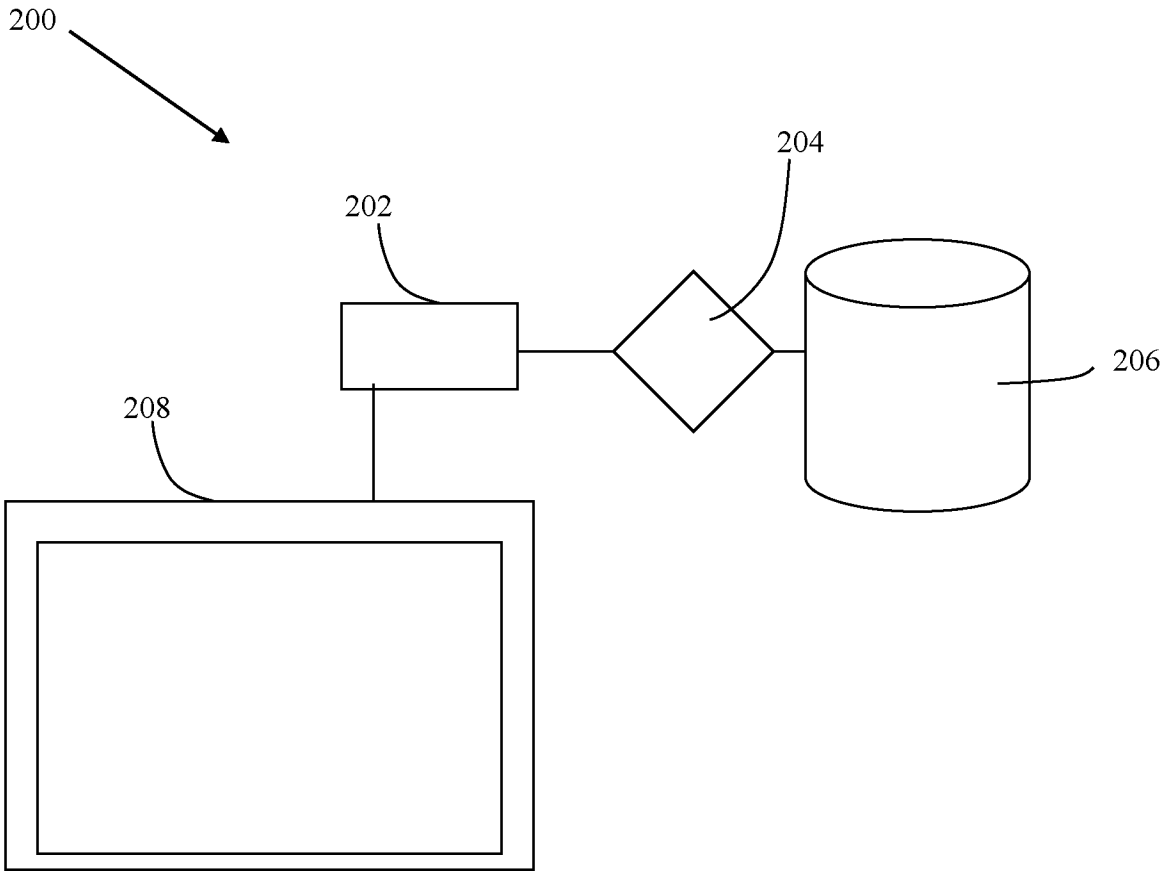
FIG. 2 illustrates a system for administering a game configured and constructed according to some embodiments the invention.

An embodiment of the invention referred to as system 200 is illustrated in FIG. 2, in which a card shuffling and recognition system 202 is in communication with the processing device 204 by wired or wireless communication methods. Additional embodiments are described hereinbelow. In short, data, including executable code is stored in memory 206, which is in communication with the processing device 204. Cards are shuffled by system 202 responsive to detection of a wager being received in any form, whether physical or virtual for example. Cards information is received as the cards are delivered by system 204 for use in the game of the invention. Responsive to the final hand being dealt, system 204, in communication with processing device 204 and memory 206, all of which may within system 202, applies the stored game information to determine the outcome of each of the hands prior to actual physical play of the game, that is, the formation of high and low player and dealer hands. In embodiments where wagers are not registered as being received, such as the use of gaming tables without bet sensors for example, the game outcomes being known means the only task left is to collect or pay based on the actual amount of the wagers received. In this embodiment, a game display 208 may be included to display outcomes or trends of the game, such as in traditional Baccarat.

Various platforms are contemplated that are suitable for implementation of embodiments of wagering games according to this disclosure. For example, embodiments of wagering games may be implemented as live table games with an in-person dealer, electronic gaming machines, partially or fully automated table games, and fully automated, network-administered games (e.g., Internet games) that either produce game results utilizing a processor, or produce a live video feed of a dealer administering a game from a remote studio.

As previously noted, any of the present methods and games may be played as a live casino table card game, as a hybrid casino table card game (with virtual cards or virtual chips), on a multiplayer electronic platform, on a personal computer for practice, on a hand-held game for practice, on a legally-authorized site on the Internet, or on a play-for-fun site on the Internet, or through any other communication network.

For example, in one embodiment, the players may be remotely located from a live dealer, and a live dealer and a game table may be displayed to players on their monitors via a video feed. The players' video feeds may be transmitted to the dealer and may also be shared among the players at the table. In a sample embodiment, a central station may include a plurality of betting-type game devices and an electronic camera for each game device. A plurality of player stations, remotely located with respect to the central station, may each include a monitor, for displaying a selected game device at the central station, and input means, for selecting a game device and for placing a bet by a player at the player's station relating to an action involving an element of chance to occur at the selected game device.

Figure 3:
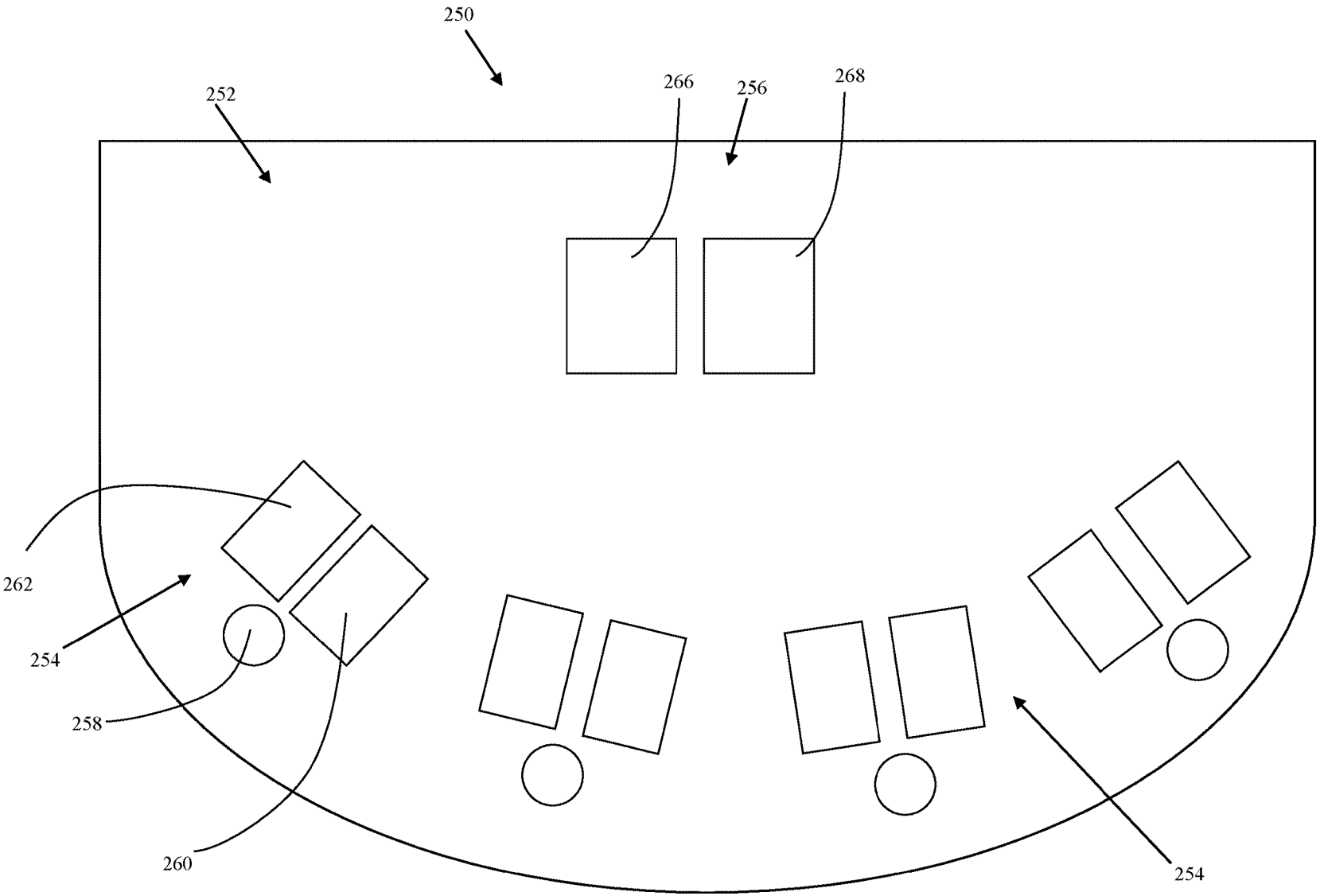
FIG. 3 is a diagram of a playing surface for implementation of a method of administering a wagering game, according to an embodiment of this disclosure.

Referring to FIG. 3, shown is a diagram of a playing surface 250 for implementation of the wagering games within the scope of the present disclosure. The gaming table surface 252 (also referred to herein as a "playing device layout") is provided by the administrator and may include multiple player areas 254 (e.g., four to seven player areas 254). While four player areas 254 are shown this is for illustrative purposes only. The gaming table surface 252 includes a dealer area 256.

Each player area 254 includes a main wager area 258, a high player hand area 260 and a low player hand area 262. In administering a round of the wagering game, wagers are received by being placed and at least partially covering their respective wager area 258. The wager areas of wagers that have been retained may be removed by the administrator (e.g., dealer). Gaming table surface 252 may also display paytables and other game information.

Cards may be distributed from a system such as the system 200 in accordance with the invention to the player areas 252 and dealer card area 256. Each player forms a high and low hand and places the hands in the corresponding high and low hand areas 260 and 262, respectively. The dealer forms a high and low hand which are placed in dealer high hand area 266 and dealer low hand area 268, respectively. As discussed above, the game outcomes having been determined, which may be displayed on a game display such as in system 200, the dealer collects or provides payouts based on the wagers in wager area 258.

Figure 4:
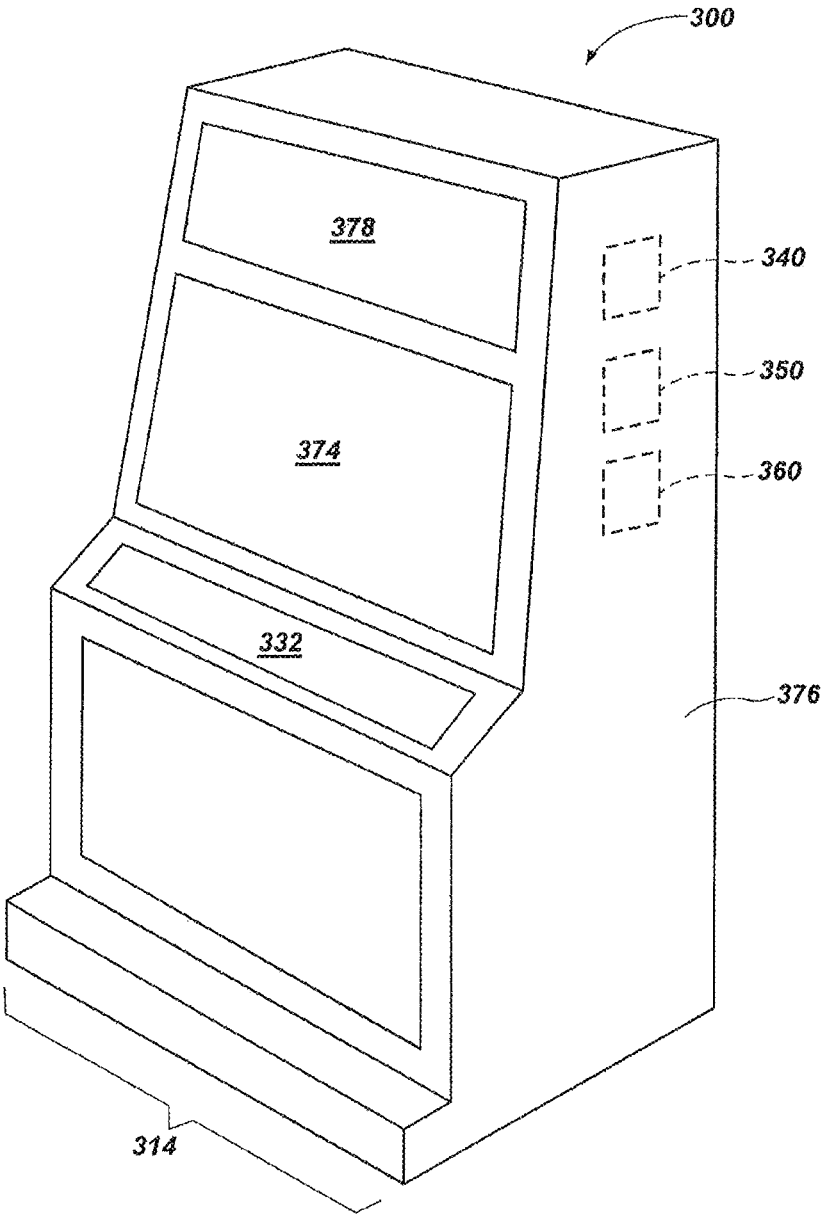
FIG. 4 is a perspective view of an individual electronic gaming device configured for implementation of embodiments of wagering games in accordance with this disclosure.

FIG. 4 is a perspective view of an individual electronic gaming device 300 (e.g., an electronic gaming machine (EGM)) configured for implementing wagering games according to this disclosure. The individual electronic gaming device 300 may include an individual player position 314 including a player input area 332 configured to enable a player to interact with the individual electronic gaming device 300 through various input devices (e.g., buttons, levers, touchscreens). The individual electronic gaming device 300 may include a gaming screen 374 configured to display indicia for interacting with the individual electronic gaming 12 device 300, such as through processing one or more programs stored in memory 340 to implement the rules of game play at the individual electronic gaming device 300. Accordingly, game play may be accommodated without involving physical playing cards, chips or other wagering elements, and live personnel. The action may instead be simulated by a control processor 350 operably coupled to the memory 340 and interacting with and controlling the individual electronic gaming device 300.

Although the individual electronic gaming device 300 displayed in FIG. 4 has an outline of a traditional gaming cabinet, the individual electronic gaming device 300 may be implemented in other ways, such as, for example, client software downloaded to a portable device, such as a smart phone, tablet, or laptop computer. The individual electronic gaming device 300 may also be a non-portable personal computer (e.g., a desktop or all-in-one computer) or other computing device. In some embodiments, client software is not downloaded but is native to the device or is otherwise delivered with the device when distributed.

A communication device 360 may be included and operably coupled to the processor 350 such that information related to operation of the individual electronic gaming device 300, information related to the game play, or combinations thereof may be communicated between the individual electronic gaming device 300 and other devices such as a server through a suitable communication medium, such, as, for example, wired networks, Wi-Fi networks, and cellular communication networks.

The gaming screen 374 may be carried by a generally vertically extending cabinet 376 of the individual electronic gaming device 300. The individual electronic gaming device 300 may further include banners to communicate rules of game play and the like, such as along a top portion 378 of the cabinet 376 of the individual electronic gaming device 300. The individual electronic gaming device 300 may further include additional decorative lights (not shown), and speakers (not shown) for transmitting and optionally receiving sounds during game play.

Some embodiments may be implemented at locations including a plurality of player stations. Such player stations may include an electronic display screen for display of game information (e.g., cards, wagers, and game instructions) and for accepting wagers and facilitating credit balance adjustments. Such player stations may, optionally, be integrated in a table format, may be distributed throughout a casino or other gaming site, or may include both grouped and distributed player stations.

Figure 5:
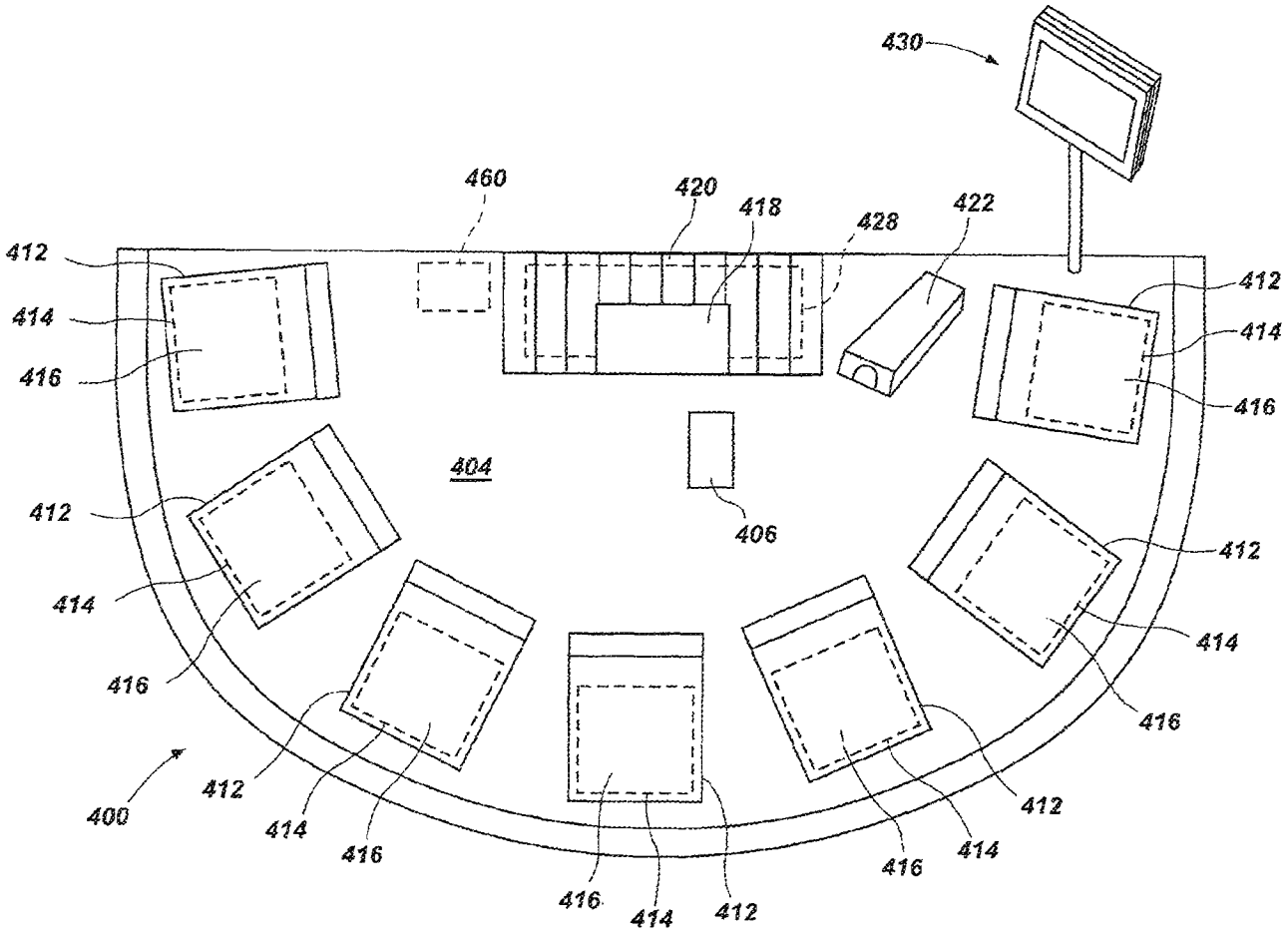
FIG. 5 is a top view of a table configured for implementation of embodiments of wagering games in accordance with this disclosure.

FIG. 5 is a top view of a suitable table 400 configured for implementing wagering games according to this disclosure. The table 400 may include a playing surface 404. The table 400 may include player stations 412. Each player station 412 may include a player interface 416, which may be used for displaying game information (e.g., game instructions, input options, wager information, game outcomes, etc., and accepting player elections). The player interface 416 may be a display screen in the form of a touch screen, which may be at least substantially flush with the playing surface 404 in some embodiments. Each player interface 416 may be operated by its own local game processor 414 (shown in dashed lines), although, in some embodiments, a central game processor 428 (shown in dashed lines) may be employed and may communicate directly with player interfaces 416. In some embodiments, a combination of individual local game processors 414 and the central game processor 428 may be employed.

A communication device 460 may be included and may be operably coupled to one or more of the local game processors 414, the central game processor 428, or combinations thereof, such that information related to operation of the table 400, information related to the game play, or combinations thereof may be communicated between the table 400 and other devices through a suitable communication medium, such as, for example, wired networks, Wi-Fi networks, and cellular communication networks.

Table 400 may further include additional features, such as a dealer chip tray 420, which may be used by the dealer to cash players in and out of the wagering game, whereas wagers and balance adjustments during game play may be performed using, for example, virtual chips (e.g., images or text representing wagers). For embodiments using physical cards, the table 400 may further include a card-handling device 422 (which may be configured to shuffle, read, and deliver physical cards for the dealer and players to use during game play or, alternatively, a card shoe configured to read and deliver cards that have already been randomized) and a designated area for physical cards 406, which may include multiple locations for the dealer hand and community cards as shown in game table surface 250. For embodiments using virtual cards, the virtual cards may be displayed at the individual player interfaces 416.

The table 400 may further include a dealer interface 418, which, like the player interfaces 416, may include touch screen controls for receiving dealer inputs and for assisting the dealer in administering the wagering game. The table 400 may further include an upright display 430 configured to display images that depict game information such as pay tables, hand counts, historical win/loss information by player, and a wide variety of other information considered useful to the players.

Although an embodiment is described showing individual discrete player stations, in some embodiments, the entire playing surface 404 may be an electronic display that is logically partitioned to permit game play from a plurality of players for receiving inputs from, and displaying game information to, the players, the dealer, or both.

Figure 6:
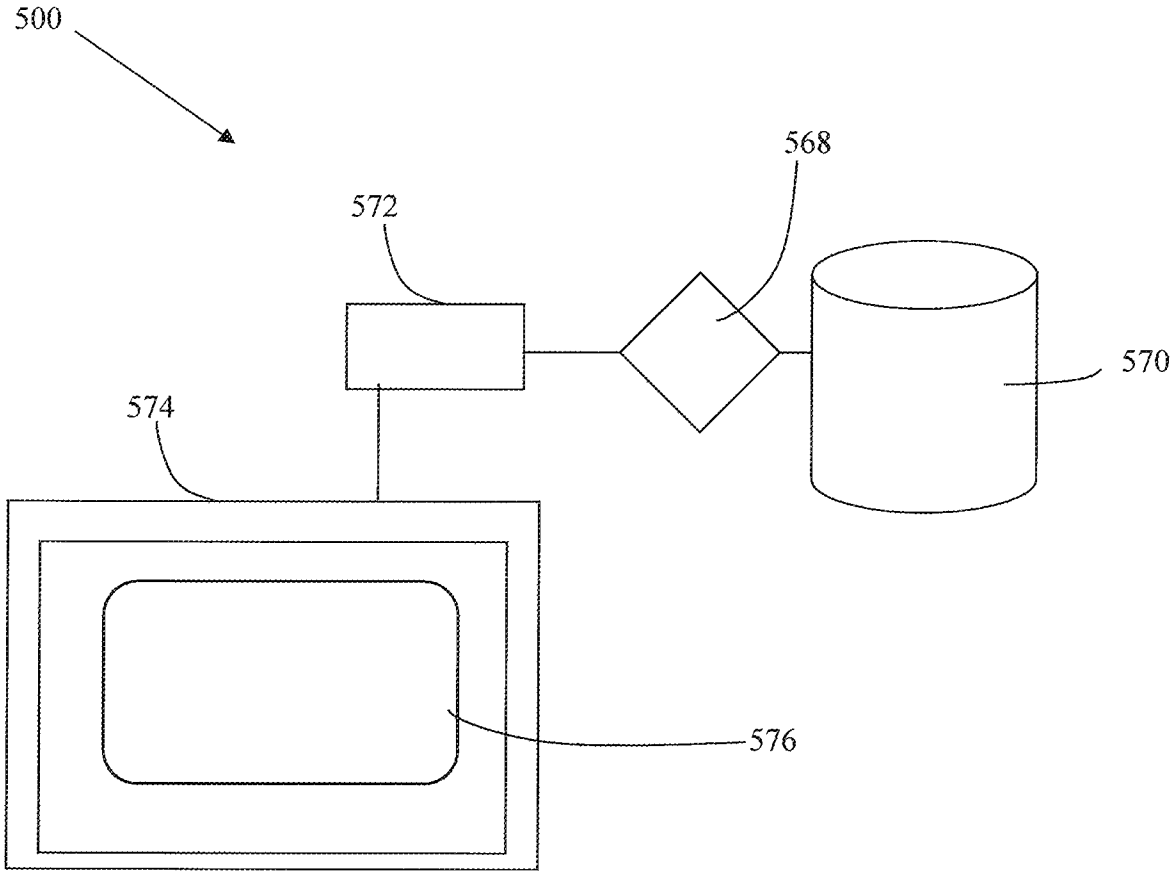
FIG. 6 is a schematic diagram depicting the components of an exemplary system configured and constructed according to some embodiments of the invention.

FIG. 6 illustrates a diagram of an exemplary system 500, which may be a portable device, constructed in accordance with some embodiments of the invention. System 500 includes processing device 568 in communication with a database or memory device 570, communication or data input/output device 572 and a display device 574. In some embodiments, display device 574 is a touch-enabled device and includes a data input device component. Memory device 570 may include data relating to the underlying game and embodiments of the invention as described herein, such as the ranking hierarchy and bonus wager criteria. A player interface 576 can be presented on display device 574. Player interface 576 may be a virtual representation of a game table layout such as surface 250 and/or one or more player positions 252 for facilitating the transmittal and receipt of wagers in accordance with any of the embodiments herein, such as method 100. Game outcomes are displayed and wagers are tracked using display device 574 and processing device 568 compares the final player and dealer hands and the bonus criteria, and determines an outcome and payout to be displayed on display device 574 accordingly.

Figure 7:
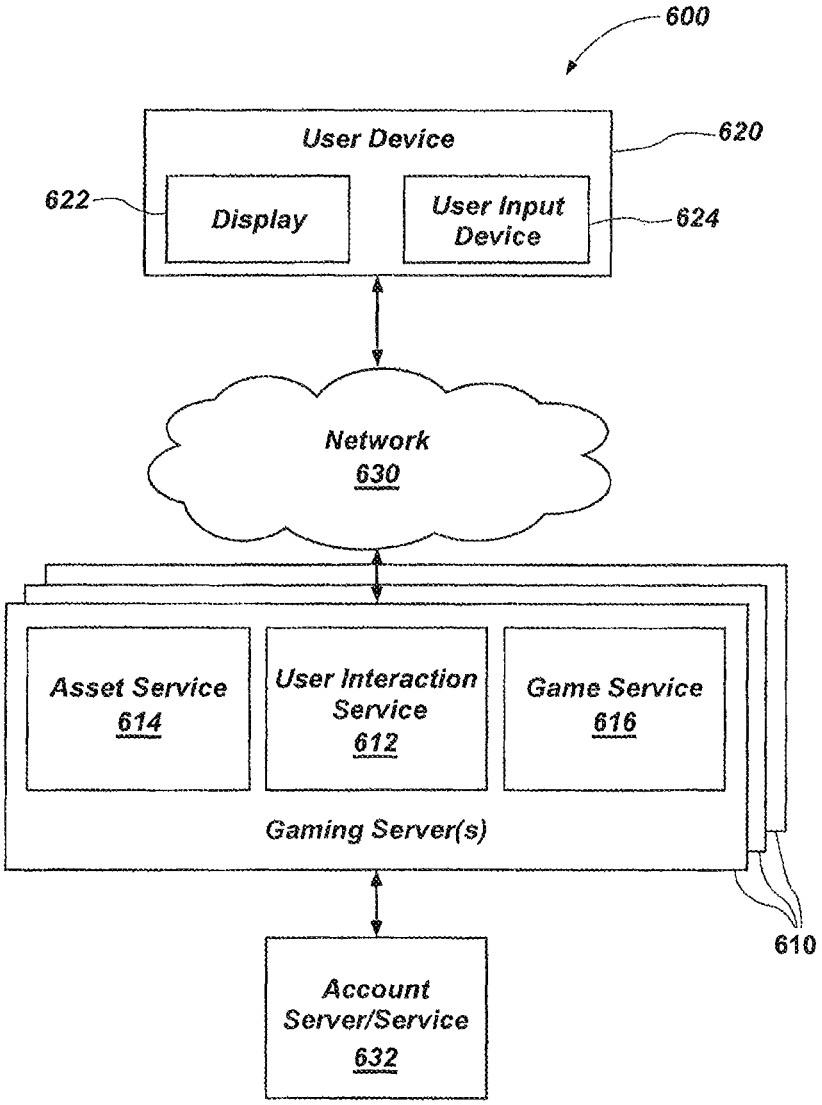
FIG. 7 is a schematic block diagram of a gaming system for implementing embodiments of waging games in accordance with this disclosure.

In some embodiments, wagering games in accordance with this disclosure may be administered using a gaming system employing a client-server architecture (e.g., over the Internet, a local area network, etc.). FIG. 7 is a schematic block diagram of an exemplary gaming system 600 for implementing wagering games so that end users may remotely access games as described herein, among others.

The wagering games supported by the gaming system 600 may be operated with real currency or with virtual credits or other virtual (e.g., electronic) value indicia. For example, the real currency option may be used with traditional casino and lottery-type wagering games in which money or other items of value are wagered and may be cashed out at the end of a game session. The virtual credits option may be used with wagering games in which credits (or other symbols) may be issued to a player to be used for the wagers. A player may be credited with credits in any way allowed, including, but not limited to, a player purchasing credits; being awarded credits as part of a contest or a win event in this or another game (including non-wagering games); being awarded credits as a reward for use of a product, casino, or other enterprise, time played in one session, or games played; or may be as simple as being awarded virtual credits upon logging in at a particular time or with a particular frequency, etc. Although credits may be won or lost, the ability of the player to cash out credits may be controlled or prevented. In one example, credits acquired (e.g., purchased or awarded) for use in a play-for-fun game may be limited to nonmonetary redemption items, awards, or credits usable in the future or for another game or gaming session. The same credit redemption restrictions may be applied to some or all of credits won in a wagering game as well.

An additional variation includes web-based sites having both play-for-fun and wagering games, including issuance of free (non-monetary) credits usable to play the play-for-fun games. This feature may attract players to the site and to the games before they engage in wagering. In some embodiments, a limited number of free or promotional credits may be issued to entice players to play the games. Another method of issuing credits includes issuing free credits in exchange for identifying friends who may want to play. In another embodiment, additional credits may be issued after a period of time has elapsed to encourage the player to resume playing the game. The gaming system 600 may enable players to buy additional game credits to allow the player to resume play. Objects of value may be awarded to play-for-fun players, which may or may not be in a direct exchange for credits. For example, a prize may be awarded or won for a highest scoring play-for-fun player during a defined time interval. All variations of credit redemption are contemplated, as desired by game designers and game hosts (the person or entity controlling the hosting systems).

The gaming system 600 may include a gaming platform to establish a portal for an end user to access a wagering game hosted by one or more gaming servers 610 over a network 630. In embodiments, games are accessed through a user interaction service 612. The gaming system 600 enables players to interact with a user device 620 through a user input device 624 and a display 622 and to communicate with one or more gaming servers 610 using a network 630 (e.g., the Internet). Typically the user device is remote from the gaming server 610 and the network is the word-wide web (i.e., internet).

In some embodiments, the gaming servers 610 may be configured as a single server to administer wagering games in combination with the user device 620. In other embodiments, the gaming servers 610 may be configured as separate servers for performing separate, dedicated functions associated with administering wagering games. Accordingly, the following description also discusses "services" with the understanding that the various services may be performed by different servers or combinations of servers in different embodiments. As shown in FIG. 7, the gaming servers 610 may include a user interaction service 612, a game service 616, and an asset service 614. In some embodiments, one or more of the gaming servers 610 may communicate with an account server 632 performing an account service 632. As explained more fully below, for some wagering type games, the account service 632 may be separate and operated by a different entity than the gaming servers 610; however, in some embodiments the account service 632 may also be operated one or more of the gaming servers 610.

The user device 620 may communicate with the user interaction service 612 through the network 630. The user interaction service 612 may communicate with the game service 616 and provide game information to the user device 620. In some embodiments, the game service 616 may also include a game engine. The game engine may comprise game rules. In some embodiments, a single user device 620 communicates with a game provided by the game service 616, while other embodiments may include a plurality of user devices 620 configured to communicate and provide end users with access to the same game provided by the game service 616. In addition, a plurality of end users may be permitted to access a single user interaction service 612, or a plurality of user interaction services 612, to access the game service 616. The user interaction service 612 may enable a user to create and access a user account and interact with game service 616. The user interaction service 612 may enable users to initiate new games, join existing games, and interface with games being played by the user.

The user interaction service 612 may also provide a client for execution on the user device 620 for accessing the gaming servers 610. The client provided by the gaming servers 610 for execution on the user device 620 may be any of a variety of implementations depending on the user device 620 and method of communication with the gaming servers 610. In one embodiment, the user device 620 may connect to the gaming servers 610 using a web browser, and the client may execute within a browser window or frame of the web browser. In another embodiment, the client may be a stand-alone executable on the user device 620.

For example, the client may comprise a relatively small amount of script, also referred to as a "script driver," including scripting language that controls an interface of the client. The script driver may include simple function calls requesting information from the gaming servers 610. In 17 other words, the script driver stored in the client may merely include calls to functions that are externally defined by, and executed by, the gaming servers 610. As a result, the client may be characterized as a "thin client." The client may simply send requests to the gaming servers 610 rather than performing logic itself. The client may receive player inputs, and the player inputs may be passed to the gaming servers 610 for processing and executing the wagering game. In some embodiments, this may involve providing specific graphical display information for the display 622 as well as game outcomes.

As another example, the client may comprise an executable file rather than a script. The client may do more local processing than does a script driver, such as calculating where to show what game symbols upon receiving a game outcome from the game service 616 through user interaction service 612. In some embodiments, portions of an asset service 614 may be loaded onto the client and may be used by the client in processing and updating graphical displays. Some form of data protection, such as end-to-end encryption, may be used when data is transported over the network 630. The network 630 may be any network, such as, for example, the Internet or a local area network.

The gaming servers 610 may include an asset service 614, which may host various media assets (e.g., text, audio, video, and image files) to send to the user device 620 for presenting the various wagering games to the end user. In other words, the assets presented to the end user may be stored separately from the user device 620. For example, the user device 620 requests the assets appropriate for the game played by the user; as another example, especially relating to thin clients, just those assets that are needed for a particular display event will be sent by the gaming servers 610, including as few as one asset. The user device 620 may call a function defined at the user interaction service 612 or asset service 614, which may determine which assets are to be delivered to the user device 620 as well as how the assets are to be presented by the user device 620 to the end user. Different assets may correspond to the various user devices 620 and their clients that may have access to the game service 616 and to different variations of wagering games.

The gaming servers 610 may include the game service 616, which may be programmed to administer wagering games and determine game play outcomes to provide to the user interaction service 612 for transmission to the user device 620. For example, the game service 616 may include game rules for one or more wagering games, such that the game service 616 controls some or all of the game flow for a selected wagering game as well as the determined game outcomes. The game service 616 may include pay tables and other game logic. The game service 616 may perform random number generation for determining random game elements of the wagering game. In one embodiment, the game service 616 may be separated from the user interaction service 612 by a firewall or other method of preventing unauthorized access to the game service 612 by the general members of the network 630.

The user device 620 may present a gaming interface to the player and communicate the user interaction from the user input device 624 to the gaming servers 610. The user device 620 may be any electronic system capable of displaying gaming information, receiving user input, and communicating the user input to the gaming servers 610. For example, the user device 620 may be a desktop computer, a laptop, a tablet computer, a set-top box, a mobile device (e.g., a smartphone), a kiosk, a terminal, or another computing device. As a specific, non-limiting example, the user device 620 operating the client may be an interactive electronic gaming system 300 (see FIG. 4) or portable system 500 (see FIG. 6), as described above. The client may be a specialized application or may be executed within a generalized application capable of interpreting instructions from an interactive gaming system, such as a web browser.

The client may interface with an end user through a web page or an application that runs on a device including, but not limited to, a smartphone, a tablet, or a general computer, or the client may be any other computer program configurable to access the gaming servers 610. The client may be illustrated within a casino webpage (or other interface) indicating that the client is embedded into a webpage, which is supported by a web browser executing on the user device 620.

In some embodiments, components of the gaming system 600 may be operated by different entities. For example, the user device 620 may be operated by a third party, such as a casino or an individual, that links to the gaming servers 610, which may be operated, for example, by a wagering game service provider. Therefore, in some embodiments, the user device 620 and client may be operated by a different administrator than the operator of the game service 616. In other words, the user device 620 may be part of a third-party system that does not administer or otherwise control the gaming servers 610 or game service 616. In other embodiments, the user interaction service 612 and asset service 614 may be operated by a third-party system. For example, a gaming entity (e.g., a casino) may operate the user interaction service 612, user device 620, or combination thereof to provide its customers access to game content managed by a different entity that may control the game service 616, amongst other functionality. In still other embodiments, all functions may be operated by the same administrator. For example, a gaming entity may elect to perform each of these functions in-house, such as providing access to the user device 620, delivering the actual game content, and administering the gaming system 600.

The gaming servers 610 may communicate with one or more external account servers 632 (also referred to herein as an account service 632), optionally through another firewall. For example, the gaming servers 610 may not directly accept wagers or issue payouts. That is, the gaming servers 610 may facilitate online casino gaming but may not be part of a self-contained online casino itself Another entity (e.g., a casino or any account holder or financial system of record) may operate and maintain its external account service 632 to accept bets and make payout distributions. The gaming servers 610 may communicate with the account service 632 to verify the existence of funds for wagering and to instruct the account service 632 to execute debits and credits. As another example, the gaming servers 610 may directly accept bets and make payout distributions, such as in the case where an administrator of the gaming servers 610 operates as a casino.

Additional features may be supported by the gaming servers 610, such as hacking and cheating detection, data storage and archival, metrics generation, messages generation, output formatting for different end user devices, as well as other features and operations.

Figure 8:
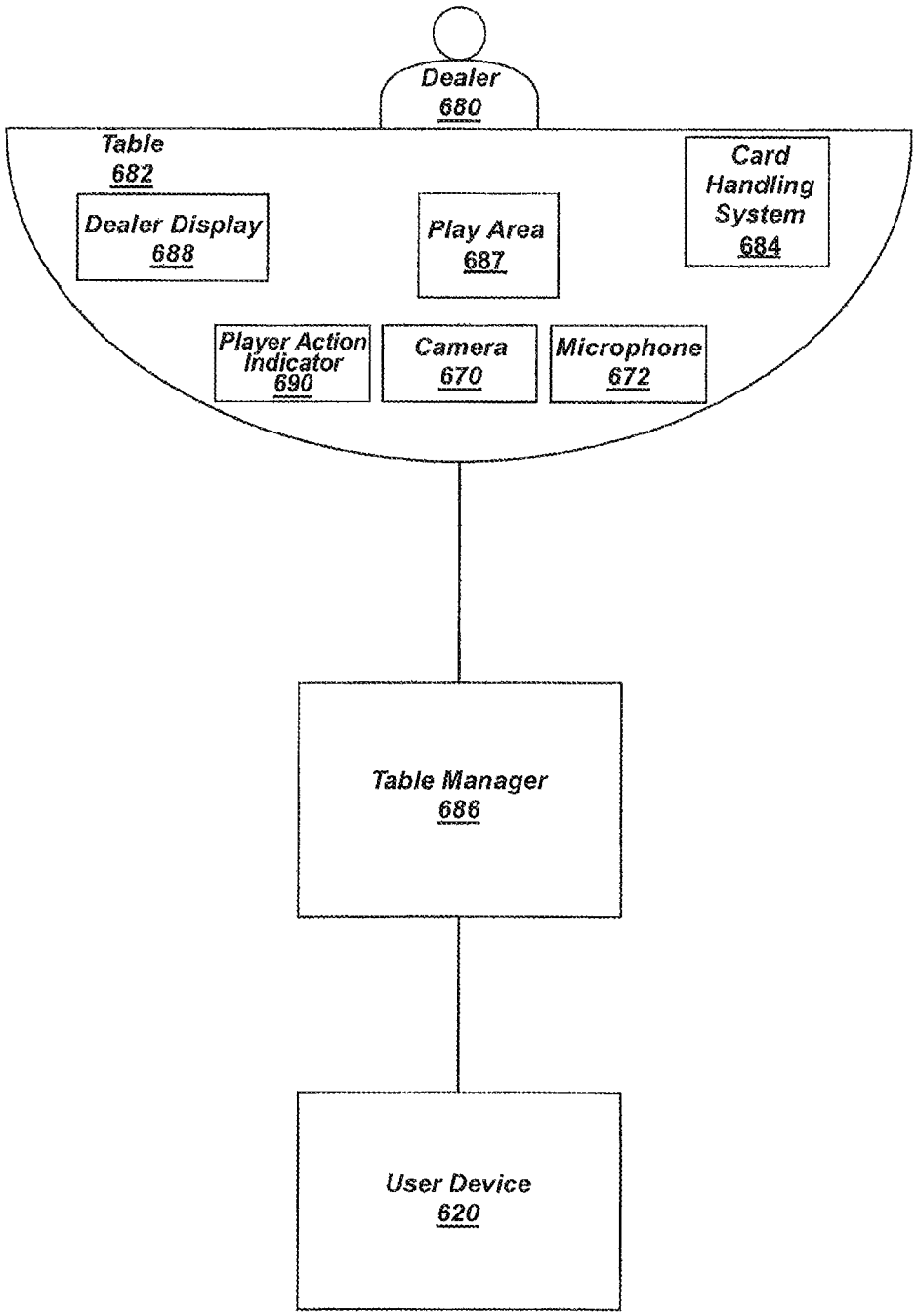
FIG. 8 is a schematic block diagram of a gaming system for implementing embodiments of wagering games including a live dealer feed.

FIG. 8 is a schematic block diagram of a table 682 for implementing wagering games including a live dealer feed. Features of the gaming system 600 described above in connection with FIG. 7 may be utilized in connection with this embodiment, except as further described. Rather than cards being determined by random computerized processes, physical cards from a non-standard deck of cards as described herein may be dealt by a live dealer 680 at a table 682 from a card handling system 684. A table manager 686 may assist the dealer 680 in facilitating play of the game by transmitting a video feed of the dealer's actions to the user device 620 and transmitting player elections to the dealer 680. As described above, the table manager 686 may act as or communicate with a gaming system 600 itself or as an intermediate client interposed between and operationally connected to the user device 620 and the gaming system 600 to provide gaming at the table 682 to users of the gaming system 600. Thus, the table manager 686 may communicate with the user device 620 through network 630, and may be a part of a larger online casino, or may be operated as a separate system facilitating game play. In various embodiments, each table 682 may be managed by an individual table manager 686 constituting a gaming device, which may receive and process information relating to that table. For simplicity of description, these functions are described as being performed by the table manager 686, though certain functions may be performed by an intermediary gaming system 600, such as the one shown and described in connection with FIG. 7. In some embodiments, the gaming system 600 may match remotely located players to tables 682 and facilitate transfer of information between user devices 620 and tables 682, such as wagering amounts and player option elections, without managing gameplay at individual tables. In other embodiments, functions of the table manager 686 may be incorporated into a gaming system 600.

The table 682 includes a camera 670 and optionally a microphone 672 to capture video and audio feeds relating to the table 682. The camera 670 may be trained on the dealer 680, play area 687, and card handling system 684. As the game is administered by the dealer 680, the video feed captured by the camera 670 may be shown to the player using the user device 620, and any audio captured by the microphone 672 may be played to the player using the user device 620. In some embodiments, the user device 620 may also include a camera, microphone, or both, which may also capture feeds to be shared with the dealer 680 and other players. In some embodiments, the camera 670 may be trained to capture images of the card faces, chips, and chip stacks on the surface of the gaming table and perform card recognition routines to identify the card rank and suit, which is well known in the art.

Card and wager data in some embodiments may be used by the table manger 686 to determine game outcome. The data extracted from the camera 670 may be used to confirm the card data obtained from the card handling system 684, to determine a player position that received a card, and for general security monitoring purposes.

The live video feed permits the dealer to show cards dealt by the card handling system and play the game as though the player were at a live casino. In addition, the dealer can prompt a user by announcing a player's election is to be performed. In embodiments in which a microphone 672 is included, the dealer 680 can verbally announce action or request an election by a player. In some embodiments, the user device 620 also includes a camera or microphone, which also captures feeds to be shared with the dealer 680 and other players.

The play area 687 may depict a player positions for playing the game, such as surface 250 shown in FIG. 3. As determined by the rules of the game, the player at the user device 620 may be presented options for responding to an event in the game using a client as described with reference to FIG. 7.

Player selections may be transmitted to the table manager 686, which may display player elections to the dealer 680 using a dealer display 688 and player action indicator 690 on the table 682. For example, the dealer display 688 may display information regarding where to deal the next card or which player position is responsible for the next action.

In some embodiments, the table manager 686 may receive card information from the card handling system 684 to identify cards dealt by the card handling system 684. For example, the card handling system 684 may include a card reader to determine card information from the cards. The card information may include the rank and suit of each dealt card, and/or hand information.

The table manager 686 may apply game rules to the card information, along with the accepted player decisions, to determine gameplay events and wager results. Alternatively, the wager results may be determined by the dealer 680 and input to the table manager 686, which may be used to confirm automatically determined results by the gaming system.

Figure 9:
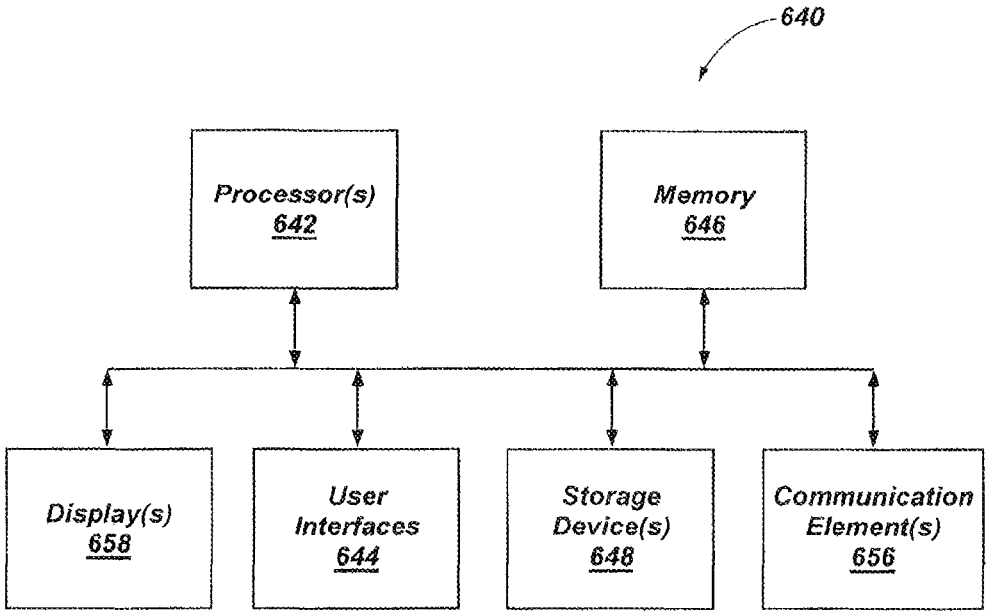
FIG. 9 is a block diagram of a computer for acting as a gaming system for implementing embodiments of wagering games in accordance with this disclosure.

FIG. 9 is a simplified block diagram showing elements of computing devices that may be used in systems and apparatuses of this disclosure. The computing system 640 may be a user-type computer, a file server, a computer server, a notebook computer, a tablet, a handheld device, a mobile device, or other similar computer system for executing software. The computing system 640 may be configured to execute software programs containing computing instructions and may include one or more processors 642, memory 646, one or more displays 658, one or more user interface elements 644, one or more communication elements 656, and one or more storage devices 648 (also referred to herein simply as storage 648).

The processors 642 may be configured to execute a wide variety of operating systems and applications including the computing instructions for administering wagering games of the present disclosure.

The memory 646 may be used to hold computing instructions, data, and other information for performing a wide variety of tasks including administering wagering games of the present disclosure. By way of example, and not limitation, the memory 646 may include Synchronous Random Access Memory (SRAM), Dynamic RAM (DRAM), Read-Only Memory (ROM), Flash memory, and the like.

The display 658 may be a wide variety of displays such as, for example, light emitting diode displays, liquid crystal displays, cathode ray tubes, and the like. In addition, the display 658 may be configured with a touch-screen feature for accepting user input as a user interface element 644.

As non-limiting examples, the user interface elements 644 may include elements such as displays, keyboards, push buttons, mice, joysticks, haptic devices, microphones, speakers, cameras, and touchscreens.

As non-limiting examples, the communication elements 656 may be configured for communicating with other devices or communication networks. As non-limiting examples, the communication elements 656 may include elements for communicating on wired and wireless communication media, such as for example, serial ports, parallel ports, Ethernet connections, universal serial bus (USB) connections, IEEE 1394 ("firewire") connections, Thunderbolt™ connections, Bluetooth® wireless networks, ZigBee wireless networks, 802.11 type wireless networks, cellular telephone/data networks, and other suitable communication interfaces and protocols.

The storage 648 may be used for storing relatively large amounts of nonvolatile information for use in the computing system 640 and may be configured as one or more storage devices. By way of example, and not limitation, these storage devices may include computer-readable media (CRM). This CRM may include, but is not limited to, magnetic and optical storage devices such as disk drives, magnetic tape, CDs (compact discs), DVDs (digital versatile discs or digital video discs), and semiconductor devices such as RAM, DRAM, ROM, EPROM, Flash memory, and other equivalent storage devices.

A person of ordinary skill in the art will recognize that the computing system 640 may be configured in many different ways with different types of interconnecting buses between the various elements. Moreover, the various elements may be subdivided physically, functionally, or a combination thereof. As one non-limiting example, the memory 646 may be divided into cache memory, graphics memory, and main memory. Each of these memories may communicate directly or indirectly with the one or more processors 642 on separate buses, partially-combined buses, or a common bus.

Some portions of the disclosure are presented in terms of algorithms (e.g., as represented in flowcharts, prose descriptions, or both) and symbolic representations of operations 23 on data bits within a computer memory. These algorithmic descriptions and representations are the means used by those skilled in the data processing arts to most effectively convey the substance of their work to others skilled in the art. An algorithm is here, and generally, conceived to be a self-consistent sequence of steps (instructions) leading to a desired result. The steps are those requiring physical manipulations of physical quantities. Usually, though not necessarily, these quantities take the form of electrical, magnetic, or optical signals capable of being stored, transferred, combined, compared, and otherwise manipulated. It is convenient at times, principally for reasons of common usage, to refer to these signals as bits, values, elements, symbols, characters, terms, numbers, or the like. Furthermore, it is also convenient at times to refer to certain arrangements of steps requiring physical manipulations or transformation of physical quantities or representations of physical quantities as modules or code devices, without loss of generality. However, all of these and similar terms are to be associated with the appropriate physical quantities and are merely convenient labels applied to these quantities. Unless specifically stated otherwise as apparent from the following discussion, it is appreciated that throughout the description, discussions utilizing terms such as "processing," "computing," "calculating," "determining," "displaying," "determining," or the like, refer to the action and processes of a computer system, or similar electronic computing device (such as a specific computing machine), that manipulates and transforms data represented as physical (electronic) quantities within the computer system memories or registers or other such information storage, transmission or display devices.

Certain aspects of the embodiments include process steps and instructions described herein in the form of an algorithm. It should be noted that the process steps and instructions of the embodiments can be embodied in software, firmware, or hardware, and when embodied in software, could be downloaded to reside on and be operated from different platforms used by a variety of operating systems. The embodiments can also be in a computer program product, which can be executed on a computing system.

Some embodiments also relate to an apparatus for performing the operations herein. Such an apparatus may be specially constructed for the purposes, e.g., a specific computer, or it may comprise a general-purpose computer selectively activated or reconfigured by a computer program stored in the computer. Such a computer program may be stored in a computer-readable storage medium, such as, but is not limited to, any type of disk including floppy disks, optical disks, CD-ROMs, magnetic-optical disks, read-only memories (ROMs), random access memories (RAMs), EPROMs, EEPROMs, magnetic or optical cards, application specific integrated circuits (ASICs), or any type of media suitable for storing electronic instructions, and each coupled to a computer system bus. Memory can include any of the above and/or other devices that can store information/data/programs and can be a transient or non-transient medium, where a non-transient or non-transitory medium can include memory/storage that stores information for more than a minimal duration. Furthermore, the computers referred to in the specification may include a single processor or may be architectures employing multiple processor designs for increased computing capability.

The algorithms and displays presented herein are not inherently related to any particular computer or other apparatus. Various general-purpose systems may also be used with programs in accordance with the teachings herein, or it may prove convenient to construct more specialized apparatus to perform the method steps. The structure for a variety of these systems will appear from the description herein. In addition, the embodiments are not described with reference to any particular programming language. It will be appreciated that a variety of programming languages may be used to implement the teachings of the embodiments as described herein, and any references herein to specific languages are provided for the purposes of enablement and best mode.

Those skilled in the art will appreciate that the types of software and hardware used are not vital to the full implementation of the methods of the invention. The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

While exemplary systems and methods, and applications of methods of the invention, have been described herein, it should also be understood that the foregoing is only illustrative of a few particular embodiments with exemplary and/or preferred features, as well as principles of the invention, and that various modifications can be made by those skilled in the art without departing from the scope and spirit of the invention. Therefore, the described embodiments should not be considered as limiting of the scope of the invention in any way. Accordingly, the invention embraces alternatives, modifications and variations which fall within the spirit and scope of the invention as set forth in the claims and equivalents thereto.

What is claimed is:

1. A system for administering a wagering game responsive to detection of a wager being received, comprising:

a wager area, a card shuffling apparatus with a card recognition system, an electronic display device, a nontransitory memory device, and a processor operatively connected to the at least one wager area, the card shuffling apparatus, the electronic display device, and the nontransitory memory device, the processor being programmed to:

accept a wager from a player via the wager area;

cause the card shuffling apparatus to output at least two groups of randomized physical playing cards from one or more fifty-two-card standard decks of playing cards randomized by the card shuffling apparatus, wherein each group is further associated with a player hand and a dealer hand responsive to distribution of the groups from the card shuffling apparatus;

receive a division of each group of cards into a high hand and low hand from each of the player and a dealer;

settle the wager received by comparing the high hand of the player to the high hand of the dealer and comparing the low hand of the player to the low hand of the dealer only according to Baccarat scoring rules;

cause the electronic display device to display a message indicating that payment of a payout to the player is authorized when the high hand of the player outranks the high hand of the dealer and the low hand of the player outranks the low hand of the dealer;

cause the electronic display device to display a message indicating that payment of a payout to the player is authorized when one of the high hand and the low hand of the player outranks a corresponding one of the high hand and the low hand of the dealer and another of the high hand and the low hand of the player ties a corresponding other of the high hand and the low hand of the dealer;

cause the electronic display device to display a message indicating that collection of the wager is authorized when the high hand of the player is outranked by the high hand of the dealer and the low hand of the player is outranked by the low hand of the dealer;

cause the electronic display device to display a message indicating that collection of the wager is authorized when one of the high hand and the low hand of the player is outranked by a corresponding one of the high hand and the low hand of the dealer and another of the high hand and the low hand of the player ties a corresponding other of the high hand and the low hand of the dealer; and cause the electronic display device to display a message indicating that return of the wager to the player is authorized for each other possible outcome.

2. A method of administering a wagering game as performed in the following order, comprising the steps of:

receiving a wager from a player;

distributing groups of cards to form a player hand and a dealer hand;

accepting a division of each group of cards being divided into a high hand and low hand by each of the player and the dealer;

settling the wager by comparing the high hand of the player to the high hand of the dealer and comparing the low hand of the player to the low hand of the dealer only according to Baccarat scoring rules;

paying a payout to the player when the high hand of the player outranks the high hand of the dealer and the low hand of the player outranks the low hand of the dealer;

paying a payout to the player when one of the high hand and the low hand of the player outranks a corresponding one of the high hand and the low hand of the dealer and another of the high hand and the low hand of the player ties a corresponding other of the high hand and the low hand of the dealer;

collecting the wager when the high hand of the player is outranked by the high hand of the dealer and the low hand of the player is outranked by the low hand of the dealer;

collecting the wager when one of the high hand and the low hand of the player is outranked by a corresponding one of the high hand and the low hand of the dealer and another of the high hand and the low hand of the player ties a corresponding other of the high hand and the low hand of the dealer; and returning the wager to the player when any other possible outcome occurs.

3. The system of claim 1, wherein the processor is programmed to cause the card shuffling apparatus to output the at least two groups of randomized physical playing cards with four cards in each of the at least two groups.

4. The system of claim 3, wherein the processor is programmed to receive the division of each group of cards into a two-card high hand and two-card low hand from each of the player and the dealer.

5. The system of claim 1, wherein the processor is programmed to accept the division of each group of cards into the high hand and low hand from each of the player and the dealer only when the high hand has a baccarat score higher than or equal to a baccarat score of the low hand.

6. The system of claim 5, wherein the processor is programmed to accept the division of each group of cards into the high hand and low hand from the dealer only when the high hand has a highest possible baccarat score formable from the cards in the group of cards available to the dealer.

7. The system of claim 1, wherein the processor is programmed to cause the electronic display device to display a message indicating that return of the wager to the player is authorized when the high hand and the low hand of the dealer do not qualify.

8. The system of claim 1, wherein the processor is programmed to cause the electronic display device to display a message indicating that payment of a payout to the player is authorized when a Baccarat score of each of the high hand and the low hand of the player is 9, regardless of a composition of each of the high hand and the low hand of the dealer.

9. The system of claim 1, further comprising another wager area and wherein the processor is programmed to accept a side wager from the player via the other wager area and cause the electronic display device to display a message indicating that payment of a payout on the side wager to the player is authorized when a Baccarat score of the high hand and the low hand of the player is 9/9, 9/8, 8/8, or 9/7.

10. The system of claim 1, further comprising another wager area and wherein the processor is programmed to accept a side wager from the player via the other wager area and cause the electronic display device to display a message indicating that payment of a payout on the side wager to the player is authorized when a Baccarat score of each of the high hand and the low hand of the player is less than a specified number.

11. The system of claim 10, wherein the processor is programmed to cause the electronic display device to display the message indicating that payment of the payout on the side wager to the player is authorized when the Baccarat score of each of the high hand and the low hand of the player is less than 6.

12. The system of claim 10, wherein the processor is programmed to cause the electronic display device to display the message indicating that payment of the payout on the side wager to the player is authorized, with an amount of the payout increasing as the Baccarat score of each of the high hand and the low hand decreases.

13. The system of claim 1, further comprising another wager area and wherein the processor is programmed to accept a side wager from the player via the other wager area and cause the electronic display device to display a message indicating that payment of a payout on the side wager to the player is authorized when a difference between Baccarat scores of the high hand and the low hand of the player is less than or equal to a specified number.

14. The system of claim 13, wherein the processor is programmed to cause the electronic display device to display the message indicating that payment of the payout on the side wager to the player is authorized when the difference between Baccarat scores of the high hand and the low hand of the player is less than or equal to 6.

15. The system of claim 1, further comprising another wager area and wherein the processor is programmed to accept a side wager from the player via the other wager area and cause the electronic display device to display a message indicating that payment of a payout on the side wager to the player is authorized when Baccarat scores of the high hand and the low hand of the player or the dealer are equal to specified numbers or where cards of the high hand and the low hand of the player or the dealer share specified characteristics.

16. The system of claim 15, wherein the processor is programmed to cause the electronic display device to display the message indicating that payment of the payout on the side wager to the player is authorized when cards of the high hand and the low hand of the player or the dealer are suited or are all one color.

17. The method of claim 2, further randomizing a set of cards utilizing a card shuffling apparatus and receiving the groups of cards from the card shuffling apparatus before distributing the groups of cards to form the player hand and the dealer hand.

18. The method of claim 17, further comprising indicating that all groups of cards are distributed after distributing the groups of cards via a user interface device of the card shuffling apparatus.

19. The method of claim 2, wherein the card shuffling apparatus comprises a card reading system and wherein comparing the high hand of the player to the high hand of the dealer and comparing the low hand of the player to the low hand of the dealer only according to Baccarat scoring rules comprises receiving playing card values from the card reading system of the card shuffling apparatus at the processor, accepting the division of each group of cards into the high hand and low hand by each of the player and the dealer at the processor, and comparing the high hand of the player to the high hand of the dealer and comparing the low hand of the player to the low hand of the dealer only according to Baccarat scoring rules at the processor.

20. The method of claim 19, wherein receiving the wager from a player comprises detecting a chip on a wager area of a gaming table utilizing a wager detector of the gaming table.

* * * * *